United States Patent [19]

Akutsu

[11] Patent Number: 4,662,261

[45] Date of Patent: May 5, 1987

[54] ELECTRONIC MUSICAL INSTRUMENT WITH AUTOPLAY FUNCTION

[75] Inventor: Takashi Akutsu, Tokyo, Japan

[73] Assignee: Casio Computer Co., Ltd., Tokyo, Japan

[21] Appl. No.: 769,870

[22] Filed: Aug. 27, 1985

[30] Foreign Application Priority Data

Sep. 7, 1984 [JP] Japan ..... 59-186442

[51] Int. Cl.[4] ..... G10H 1/18; G10H 7/00

[52] U.S. Cl. ..... 84/1.01; 84/1.03; 340/365.5

[58] Field of Search ..... 84/1.01, 1.09, 1.1, 84/1.27, DIG. 7, 1.03; 340/365.5

[56] References Cited

U.S. PATENT DOCUMENTS 4,014,238 3/1977 Southard ..... 84/1.13

4,570,520 2/1986 Deutsch et al. ..... 84/1.01

*Primary Examiner*—S. J. Witkowski

*Attorney, Agent, or Firm*—Frishauf, Holtz, Goodman & Woodward

[57] ABSTRACT

When key-off information is given after the start of an operation of generating a predetermined tone according to key-on information, a predetermined period of time is counted from the instant the key-off information is provided and, after the lapse of the predetermined period of time, a process of stopping the tone is executed, whereby a minimum necessary interval of a tone can, according to a key signal, be ensured.

5 Claims, 8 Drawing Figures

ELECTRONIC MUSICAL INSTRUMENT WITH AUTOPLAY FUNCTION

BACKGROUND OF THE INVENTION

This invention relates to an electronic musical instrument, with an autoplay function, for generating a tone according to a given key signal.

Recently, an electronic musical instrument has been developed to which key-on and key-off information can be transmitted, for autoplay, in the correct tempo from a personal computer. In this instrument, the attack part of the waveform of a tone envelope rises comparatively gently depending on the timbre of the tone generated from the electronic musical instrument. When a quicker tempo is set, the period during which the key-on and key-off information is transferred from the personal computer to the electronic musical instrument is reduced. Consequently, the key release is started when the attack part of the tone envelope is not yet sufficiently formed, so that the tone fails to be sounded; an undesirable state of affairs from the standpoint of satisfactory autoplay.

SUMMARY OF THE INVENTION

The object of the invention, accordingly, is to provide an electronic musical instrument, with an autoplay function, in which any tone can be sounded without fail for at least a minimum necessary period even if the tempo of the music is quick.

According to the invention, there is provided an electronic musical instrument which comprises key signal generating means for generating a key signal containing key-on information and key-off information of a tone to be sounded, tone signal generating means for generating a predetermined tone signal according to the key-on information, tone generating means for generating a tone according to the tone signal, time counting means for starting a time counting operation responsive key-off information while the tone is being generated, and stopping process starting means for starting a stopping process of the generated tone at the instant a predetermined elapsed period of time is counted by the time counting means after generation of the key-off information.

DETAILED DESCRIPTION OF THE PREFERRED EMBODIMENT

Figure 1:
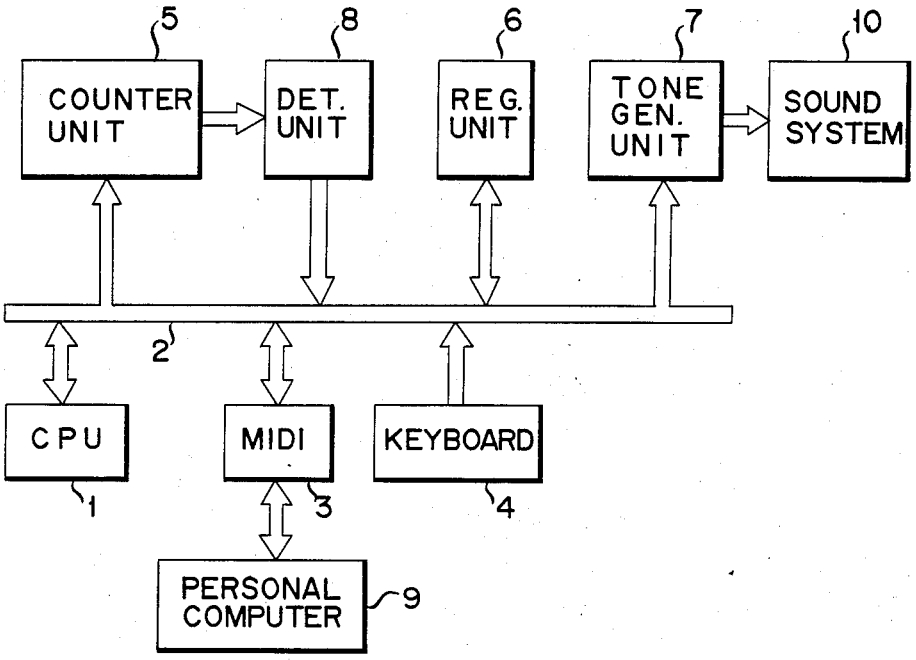
FIG. 1 is a block diagram showing an embodiment of the electronic musical instrument.

An embodiment of the invention will now be described with reference to the drawings. FIG. 1 is a block diagram showing an electronic musical instrument with an autoplay function.

Referring to the Figure, reference numeral 1 designates a CPU (central processing unit). A MIDI (musical instrument digital interface) 3, a keyboard 4, a counter unit 5, a register unit 6 and a tone generating unit 7 are connected to the CPU 1 via a bus line 2. The CPU 1 consists of a microprocessor, or the like, and effects control of all the operations of the electronic musical instrument. A personal computer 9 is connected to the MIDI 3, and data for autoplay can be sent from the personal computer 9 to the CPU 1. The keyboard 4 has 61 manual play keys which are periodially scanned by the CPU 1, on/off data of the individual keys being fed to the CPU 1.

In accordance with autoplay information, e.g., key-on and key-off information provided from the personal computer 9, the counter unit 5 counts a predetermined delay time after the delivery of a key-off command at the time of autoplay. The counted time data of the counter unit 5 is fed to a detecting unit 8 which checks whether the predetermined delay time noted above has been reached. The resultant data of the check is fed to the CPU 1 via the bus line 2.

The register unit 6 includes various registers which are used by the CPU 1 for play control. The tone generating unit 7 generates tone signals according to tone generation commands provided from the CPU 1, sounds corresponding to the generated tone signals are generated through a sound system 10 including an amplifier and a loudspeaker.

Figure 2:
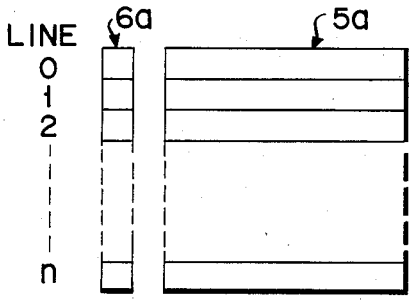
FIG. 2 is a view showing specific contents of the counter unit and the register unit shown in FIG. 1.

FIG. 2 shows some of the registers in the counter unit 5 and register unit 6. The instant electronic musical instrument is constructed as an n-tone polyphonic musical instrument. Lines 0 to n represent the respective tone generation line memories of an (n+1)-tone polyphonic system. Each of the lines 0 to n includes a key-off exist flag register 6*a* in the register unit 6 and a key-off delay counter 5*a* in the counter unit 5. A flag "1" is set in the key-off exist flag register 6*a* in response to a key-off command. The key-off delay counter 5*a* is used to obtain the predetermined delay time noted above after the key-off command has been received.

The operation of this embodiment will now be described. General operation will first be described with reference to FIG. 1. In the ordinary manual play, on and off signals of the individual keys of the keyboard 4 are fed to the CPU 1. The CPU 1 feeds a corresponding tone generation command to the tone generating unit 7 to generate a tone signal, the tone of which is generated from the loudspeaker in the sound system 10.

In autoplay, and according to data from the personal computer 9, key-on and off data are fed through the MIDI 3 to the CPU 1. The CPU 1 controls the counter unit 5 and detecting unit 8 according to the input key-on and off data, whereby a tone generation command, to be fed to the tone generating unit 7, is produced. In this way, autoplay tones are generated from the loudspeaker of the sound system 10.

Figure 3:
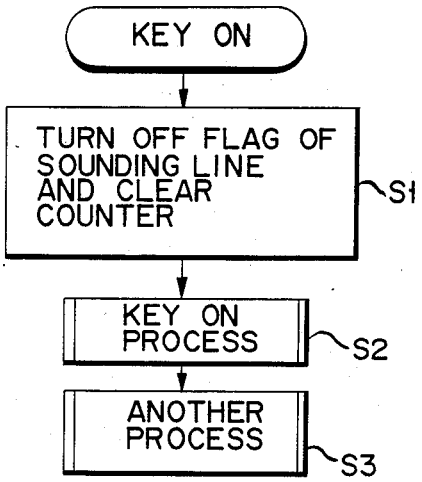
FIG. 3 is a flow chart illustrating the operation of the embodiment shown in FIG. 1 when key-on information is given.

The operation will now be described in detail with reference to FIGS. 3 to 8. Referring to FIG. 3, in the case of either manual play or autoplay the CPU 1, in response to a key-off command, turns off (i.e., makes "0") the key-off exist flag in the register 6*a* of the sounding line (FIG. 2) and also clears the key-off delay counter 5*a* of the same line (FIG. 2, step S1). Then, a key-on process for sounding is executed (step S2). Subsequently, another process, e.g., the key scanning, is executed (step S3).

Figure 4:
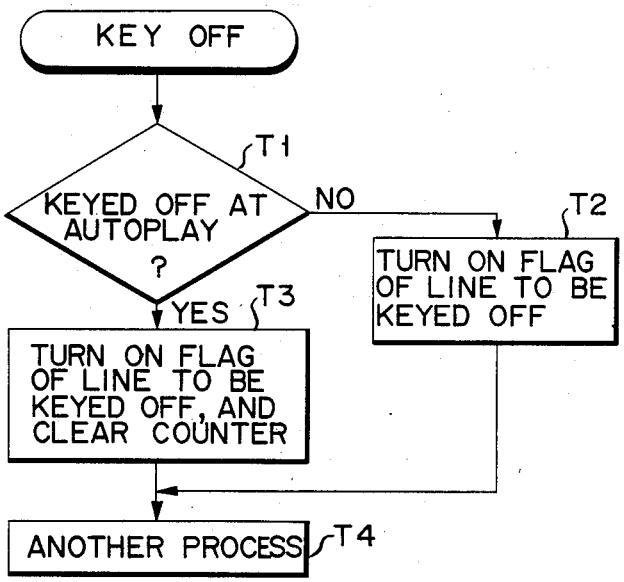
FIG. 4 is a flow chart illustrating the operation of the embodiment shown in FIG. 1 when key-off information is given.

Referring now to FIG. 4, when a key-off command is provided, a check is done as to whether the key-off is in manual play or autoplay (step T1). In case of manual play, the routine proceeds to step T2 in which the key-off exist flag of the line to be keyed off (FIG. 2) is turned off (i.e., made "0"), another process being executed (step T4) thereafter. Therefore, in manual play the process of providing the predetermined delay time noted above is not executed, and tones are sounded according to the player's wishes.

Figure 6:
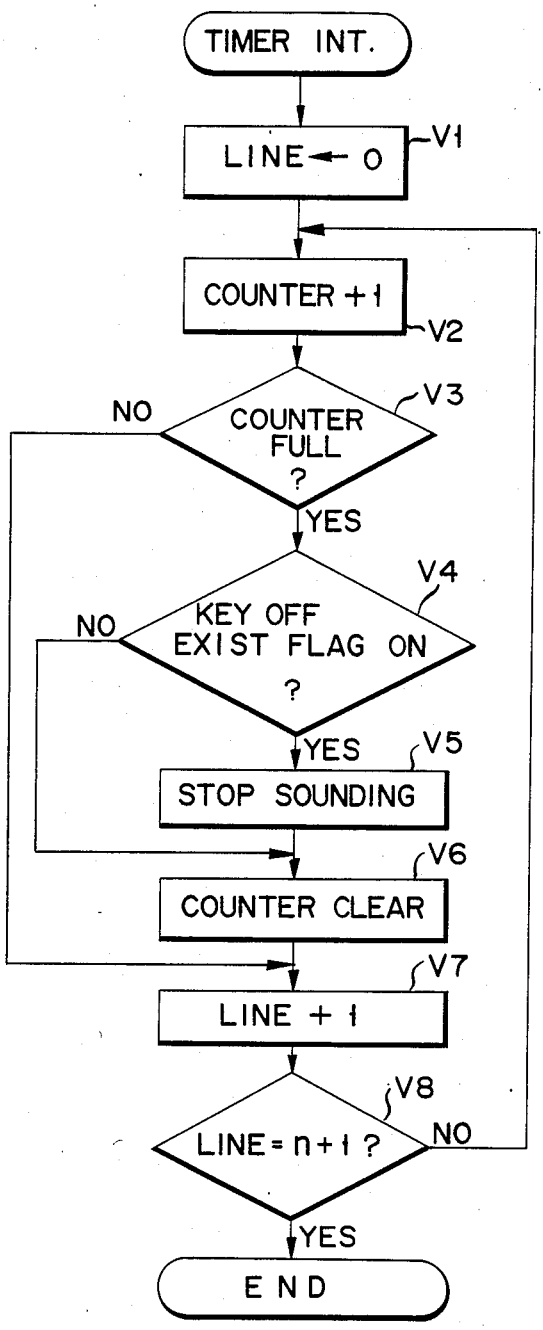
FIG. 6 is a flow chart illustrating a timer interrupt process.

In case of autoplay, the routine proceeds to step T3 in which the key-off exist flag of the line to be keyed off is turned on (i.e., made "1") and the key-off delay counter of the same line is cleared to start the counting of the delay time noted above, a timer interrupt process to be described later in connection with FIG. 6.

Figure 5:
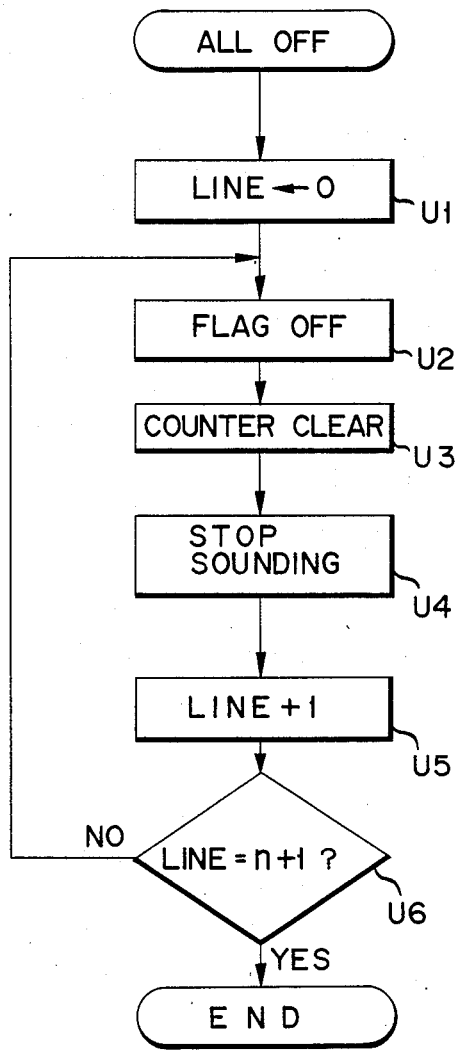
FIG. 5 is a flow chart illustrating an all-line key-off process.

FIG. 5 illustrates the routine when all of the lines are keyed off, as in the case of switching timbres. First, a line counter in the register unit 6 is cleared to "0" to start a key-off process from line 0 (step U1). Then, the key-off exist flag of the line 0 is turned off (i.e., made "0") (step U2), the key-off delay counter of the same line is cleared (step U3), and the process of stopping the sounding is executed (step U4). Thereafter, the content of the line counter is incremented by +1 to "1" so as to ready it for the process for the next line 1 (step U5). Then, a check is done as to whether the content of the line counter is "n+1", i.e., whether the process for all the lines has been completed in step U6. If the process has not yet ended, the routine goes back to step U2 to start the process for the succeeding line. If the process is over, it brings the routine to an end.

The key-off exist flag turn off process of the above-noted step U2 has the effect of preventing a line tone to which the delay time is provided before the start of the autoplay routine, from being influenced by the delay time with a key-on operation after the start of the routine's execution.

The timer interrupt process for obtaining the delay time noted above in the case of autoplay will now be described with reference to FIG. 6. The timer interrupt routine is executed every 4 msec. so that it is executed for a tone of the shortest tone interval.

First, the line counter is cleared to "0" to start the process from line 0 (step V1). Then, the key-off delay counter of the line 0 is incremented by +1 to "1" (step V2). Then, a check is done as to whether the count of the counter is full e.g., "4" in step V3. If the count is not full, the routine proceeds to step V7 in which the line counter is incremented by +1 to designate the next line. Then, a check is done as to whether the process for all the lines is over (step V8). If the process is not over, the routine goes back to step V2 for the counting of the delay time of the next line. If the process is over, it brings the timer interrupt routine to an end.

Figure 7:
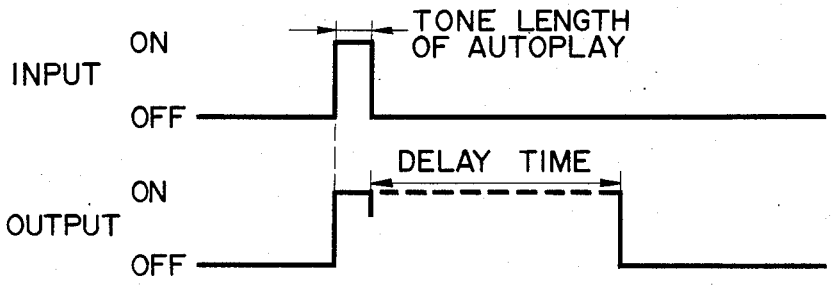
FIGS. 7 and 8 are diagrams explaining specific examples of key-on and key-off operations.

If it is found, in step V3, that the count of the key-off delay counter is full, e.g., "4", the routine proceeds to step V4 in which a check is done as to whether the key-off exist flag is "on". When a key-on command and a key-off command are provided only once at an interval as shown in FIG. 7, the key-off exist flag is "on" (i.e., "1") and the routine proceeds to step V5 to stop the sounding. The tone is thus stopped after the lapse of a predetermined delay time (e.g., 12 msec.) from the key-off command, as shown in FIG. 7. Thus, even the short interval tone in music of a quick tempo can be sufficiently audible.

Then, step V6 is executed in which the key-off delay counter of the pertinent line is cleared, with the routine then proceeding to step V7.

Figure 8:
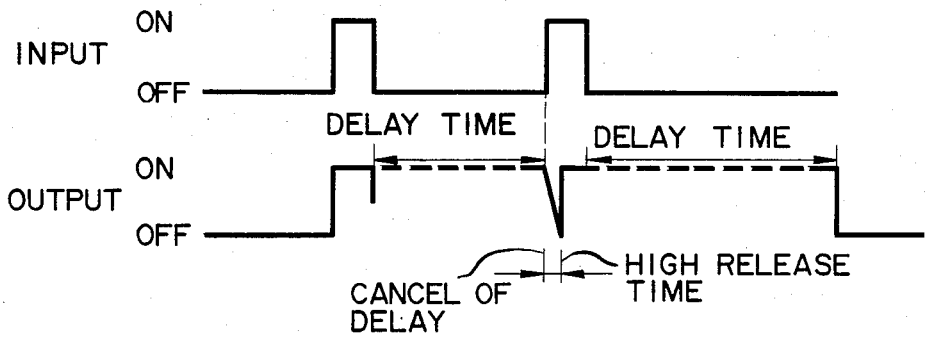

When the next key-on command is provided while the delay time of the previous tone is not yet over, as shown in FIG. 8, the key-off exist flag is turned on (i.e., made "0") again in the key-on process (step S1) shown in FIG. 8. With the key-on process the delay time of a first tone is quickly cancelled, i.e., the tone is released and the process of sounding a second tone is executed (step S2). Thus, there is no possibility that the first and second tones are heard continuously, nor there is a possibility of the second tone losing its attack. That is, even when two tones are successively turned on and off within a short interval in the same sounding line, the sounding of the first tone is quickly stopped with a high degree of release, thus making the quality of the attack of the second tone clear and distinct.

As has been described in the foregoing, with the electronic musical instrument according to the invention, the process of producing a tone is executed only after the lapse of a predetermined period of time from the appearance of a key-off command for the tone being sounded. Therefore, even if a short interval tone in quick tempo music is sounded for a minimum necessary interval of time, the music can be heard in its natural form. This effect is particularly useful in the autoplay of music.

What is claimed is:

1. An electronic musical instrument comprising:
   - key signal generating means for generating a key signal containing key-on information and key-off information of a tone to be sounded;
   - tone signal generating means for generating a predetermined tone signal according to said key-on information;
   - tone generating means for generating a tone according to said tone signal;
   - time counting means responsive to said key-off information for starting time counting when key-off information is generated by said key signal generating means while said tone is being generated; and
   - stopping process starting means for supplying a signal to said tone signal generating means to start a stopping process of the generated tone at the instant a predetermined elapsed period of time is counted by said time counting means after generation of said key-off information by said key signal generating means.

2. The electronic musical instrument according to claim 1, which further comprises:
   - detecting means for detecting the generation of key-on information of the next tone during said predetermined period of time; and
   - stopping means for stopping the generated tone as soon as the next said key-on information is detected.

3. The electronic musical instrument according to claim 1, which further comprises a key-off exist flag register to be turned on when key-off information is generated, said time counting means including a key-off delay counter for starting a time counting operation when said key-off exist flag register is turned on.

4. The electronic musical instrument according to claim 1, wherein said tone signal generating means and time counting means each have a multi-stage structure for a polyphonic system.

5. The electronic musical instrument according to claim 1, wherein said key signal generating means includes an interface means coupled to an external data processing unit for receiving key-on and key-off information.

* * * * *